United States Patent [19]

Tench, Jr.

[11] Patent Number: 4,510,758

[45] Date of Patent: Apr. 16, 1985

[54] CONVERTIBLE CRYOSTAT

[75] Inventor: Orren K. Tench, Jr., Wethersfield, Conn.

[73] Assignee: Canberra Industries, Inc., Meriden, Conn.

[21] Appl. No.: 505,725

[22] Filed: Jun. 20, 1983

[51] Int. Cl.[3] ..... F17C 1/00

[52] U.S. Cl. ..... 62/45; 62/514 R

[58] Field of Search ..... 62/45, 514 R

[56] References Cited

U.S. PATENT DOCUMENTS

| | | | |
|---|---|---|---|
| 3,025,680 | 3/1962 | De Brosse et al. | 62/514 R |
| 3,066,222 | 11/1962 | Poorman et al. | 62/514 R |
| 3,483,709 | 12/1969 | Baicker et al. | 62/514 R |
| 4,218,892 | 8/1980 | Stephens | 62/514 R |
| 4,228,662 | 10/1980 | Klipping | 62/514 R |
| 4,259,846 | 4/1981 | Rudolphi et al. | 62/514 R |
| 4,279,127 | 7/1981 | Longsworth | 62/514 R |
| 4,317,336 | 3/1982 | Bennett et al. | 62/514 R |

*Primary Examiner*—Ronald C. Capossela

*Attorney, Agent, or Firm*—Hayes & Reinsmith

[57] ABSTRACT

A cryostat of the Dewar-flask type for maintaining extremely low, substantially constant temperatures for various detectors or other devices in good heat conducting relationship with the liquid nitrogen or other cryogen which cryostat has plural ports for accepting the detector assembly so as to permit multi-axial detector placement in the same cryostat without structural modification.

5 Claims, 4 Drawing Figures

CONVERTIBLE CRYOSTAT

BACKGROUND OF THE INVENTION

1. Field of the Invention

This invention relates to cryostats used for cooling various devices and is particularly useful in the proper cooling of semi-conductor radiation detectors.

2. Description of the Prior Art

Dewar-flask type cryostats have long been used to provide a extremely low and substantially constant temperature through utilization of liquid nitrogen or other substantially inert cryogens contained within the cryostat. Exemplary of such cryostats are the devices shown in U.S. Pat. No. 4,218,892, issued on Aug. 26, 1980 to James B. Stephens wherein an object or device to be cooled is placed exteriorly of the cryostat with the low temperature environment for the experiment package being achieved by a suitable heat conducting structure or cold finger extending into the cryogen within the cryostat itself. However, as is immediately apparent, the orientation of the experiment package of the '892 patent is limited by the cryostat structure that requires insertion of the cold finger into the open neck of the cryostat; it is also apparent that the cryogen must be permitted to continuously evaporate and be vented to the outside atmosphere from the cryostat, thereby determining certain structural features and the orientation of the cryostat itself. Canberra Industries, Inc., assignee of the present invention, has provided cryostats in combination with detectors contained within the desired cold finger, which cryostats are specifically designed for single orientation cryostat usage and with single orientation detector placement. While such arrangements are well known in the art and are shown in Canberra Publication No. B1R3M5, each such cryostat/detector combination has a specific limited orientation of use.

OBJECTS OF THE INVENTION

It is therefore a principal object of this invention to provide a cryostat having plural, separate openings into which a device chamber and associated cold finger may be inserted thereby to permit multi-axis detector placement to accommodate a variety of desired detector or specimen locations without necessitating structural modification or replacement of the cryostat itself.

It is a further object of this invention to provide an improved cryostat for cooling devices, particularly semi-conductor radiation detectors, which cryostat has a single cryogen useful to provide the desired low temperature to two or more separate "cold ports" thereby to permit simultaneous use of plural detectors each having its own separate cold finger construction for conducting heat away from the device to be maintained at low temperature.

It is an additional object to provide a multi-port cryostat having particular utility with detectors such as germanium detectors which permits a plurality of operating positions for each such detector without replacement of the cryostat thereby permitting improved cryostat usage and flexibility of use with attendant low costs.

It is a still further object of the invention to provide an improved cryostat having plural ports through which objects may be cooled and whereby the device to be cooled may be shifted from one port to another or rotated in a particular port thereby to change the orientation and/or location of the device to be cooled without requiring special tools and equipment or loss of vacuum in the Dewar-type cryostat.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments which are indicative of the various ways in which the principles of the invention are employed.

SUMMARY OF THE INVENTION

A single cryostat of the Dewar-flask type is provided with plural ports to permit cooling of a device through each such port thereby to permit flexibility in the selection of the orientation of the device to be cooled as well as to permit utilization of two or more devices as, for example, two different detectors used for gamma ray spectroscopy, such cryostat having a unique construction which preserves the vacuum of the Dewar and of the device chamber, at the same time, permitting device chambers to be inserted and removed from the cryostat.

BRIEF DESCRIPTION OF TYPICAL PRIOR ART CRYOSTAT

Figure 1:
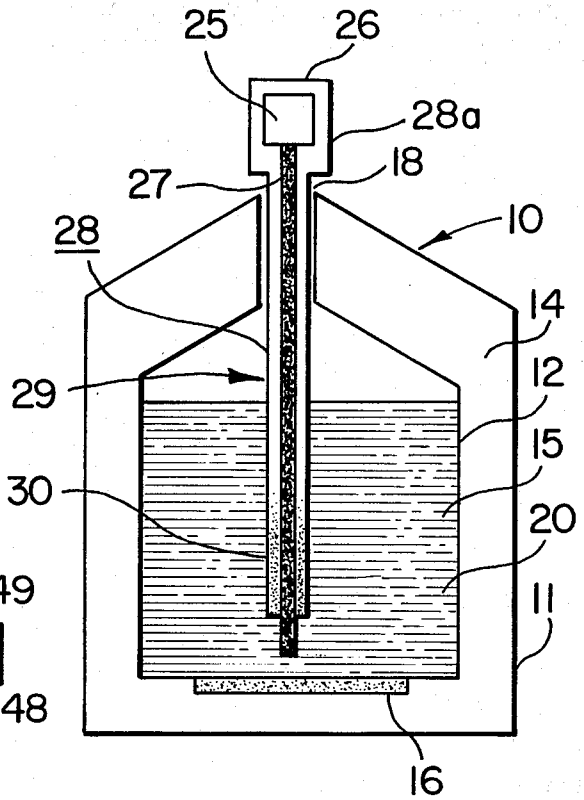
FIG. 1 is a schematic cross-section view of a typical prior art dipstick cryostat.

Turning first to FIG. 1, the number 10 generally indicates a Dewar having a metal outer wall 11 and a metal inner wall 12 which, when joined together and appropriately sealed, defines a two-walled container with the space 14 between the walls evacuated so as to minimize heat transfer from the interior container generally designated 15 to the outside environment. It is customary to provide a molecular sieve or getter 16 disposed between the inner and outer walls to assist in maintaining the desired vacuum. It is known to use synthetic or natural zeolite, in an amount and location which is a matter of choice, as the getter. The container 10 is provided with an open neck 18 so that the liquid nitrogen 20 which is used as the cryogen is permitted to "boil" with the continuous evaporation that is required in such a container being permitted through the open neck 18.

The device to be cooled is generally designated 25 and such device can be any suitable object which, because intended use or analysis, must be kept at very low temperature; for purposes of typical description only, device 25 is identified as being a germanium detector such as is commonly used in gamma ray spectroscopy. Device 25 is provided with its own housing 26, which housing is intimately affixed in good heat-conducting relationship to a cold finger 27 which extends well into the liquid cryogen 20. To assure effective heat transfer without undue heat loss, a chamber 28 surrounds both device 25 and much of cold finger 27 and extends well into cryogen 20 in Dewar container 10. It is typical to form the upper housing 28*a* of such chamber from aluminum, the lower portion 29 of the chamber 28 from stainless steel, and the cold finger 27 from copper. The end of cold finger 27 protrudes through the end of the stainless steel portion 29 of the chamber 28 to be an intimate contact with the cryogen with upper housing 28*a* and, lower chamber portion 29 sealed together and to the lower end of cold finger 27. The space defined by the chamber members is evacuated and provided with getter material 30 as may be desired to assist in preserving the vacuum.

In operation, the continuously evaporating liquid cryogen 20 is vented to the atmosphere through aperture 18 and the device 25 is maintained at or very near the temperature of the liquid cryogen by the cold finger 27 which is an intimate engagement with the liquid cryogen and in intimate engagement with the object; unwanted heat transfer occasioned by the assembly including the cold finger is minimized by evacuating chamber 28.

Such an arrangement while typical in the prior art, severely limits the placement of the device to be cooled and thereby inhibits use of the device when, for example, specific differing device locations are required.

Figure 2:
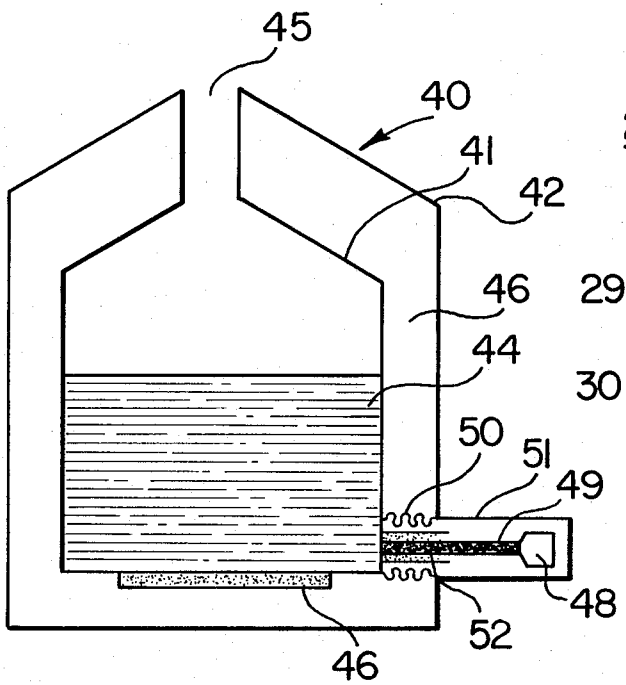
FIG. 2 is a schematic cross-section view of a typical prior art side mount cryostat having a separate vacuum chamber for the device.

Turning next to FIG. 2 showing a second prior art device, it is seen that cryostat 40 is provided with suitable inner wall 41 and outer wall 42, appropriately joined and sealed together to form a Dewar container containing cryogen 44, which cryogen evaporates through open neck 45. Getter 46 is provided to assist in maintaining the desired vacuum in the space 46 between the inner and outer walls of cryostat 40. Device 48, the object to be cooled, is affixed in good heat conducting relationship with a suitable cold finger 49, the other end of which is affixed in good heat-conducting relationship with inner wall 41 of cryostat 40. The desired vacuum between walls 41 and 42 of cryostat 40 and maintained by a suitable bellows affixed and sealed to walls 41 and 42 and also to housing 51 thereby to provide a closed container for device 48 with cold finger 49 in good heat conducting relationship with both wall 41 and device 48; to assist in maintaining a low-heat loss vacuum within the closed container, getter material 52 is provided. While the foregoing arrangement provides a location for device 48 different from that of neck 45, such location is fixed, integral with cryostat 40 and requires factory attention for adjustment and repair.

Figure 3:
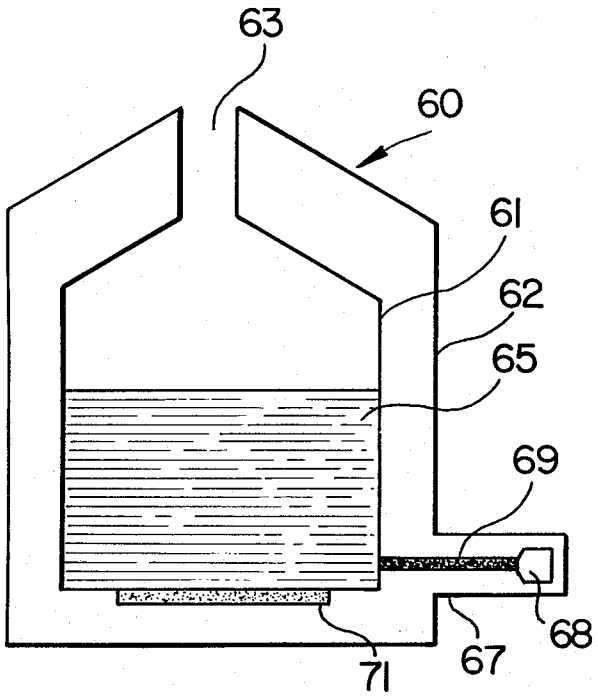
FIG. 3 is a schematic cross-section view of a typical prior art side mount cryostat wherein the main Dewar vacuum chamber includes the device.

FIG. 3 also discloses a prior art cryostat 60 having suitable inner and outer walls 61 and 62 and open neck 63 with inner wall 61 forming the container for cryogen 65. Outer wall 62 is modified adjacent the bottom of the cryostat to provide a sealed enclosure 67 for device 68 which is in good heat conducting relationship with cold finger 69. Finger 69, in turn, is affixed to inner wall 61 in good heat conducting relationship with cryogen 65. Such an arrangement provides a common vacuum between inner wall 61 and outer 62 of the Dewar and for enclosure 67 containing the device 68 and cold finger 69; hence, only a single getter 71 is provided to assist in maintaining the vacuum. As with the device of FIG. 2, a desired location for device 68 is provided but such location is fixed and factory attention is required for refurbishing and repair.

DESCRIPTION OF A PREFERRED EMBODIMENT

Figure 4:
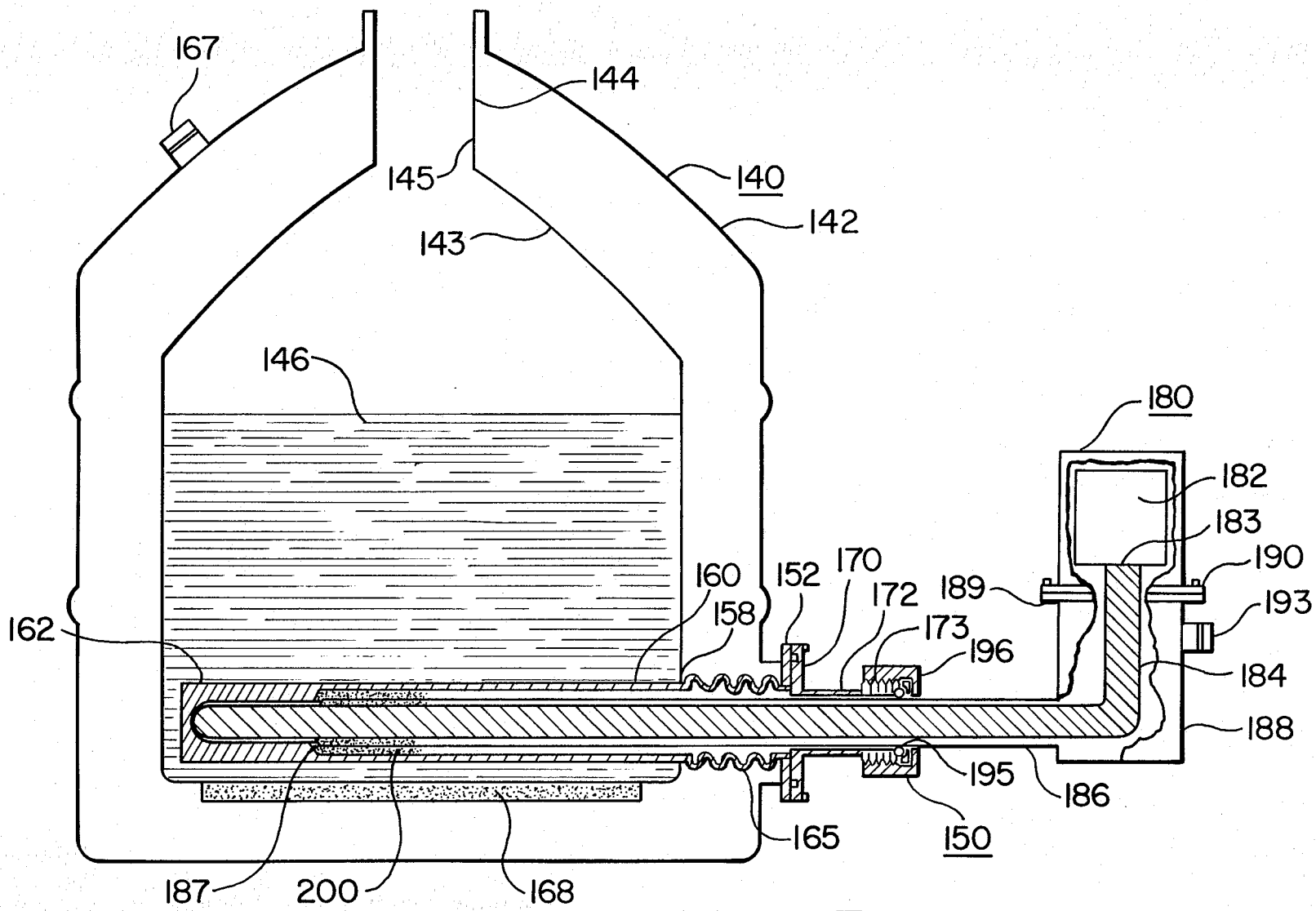
FIG. 4 is a cross-section view showing a preferred embodiment of the present invention.

Turning now to FIG. 4 which illustrates a preferred embodiment of this invention in cross-section view, it is seen that a modified cryostat 140 is provided, which cryostat typically has a stainless steel outer vessel 142 and a stainless steel inner vessel 143 which are suitably joined together and hermetically sealed to provide cryostat neck 144. The neck tube 145 is preferably of low thermal conductivity material and thus stainless steel or fiberglass are often used, suitable brazing or welding being used in connection with the stainless steel and a suitable epoxy bonding being provided if fiberglass is utilized. Such a general two-wall Dewar type container with neck 144 is typical of prior art constructions such as discussed in connection with FIGS. 1–3 with port or neck opening 144 providing the access for a conventional device chamber. For purposes of this description, the word "device chamber" is defined as a structure including the cold finger, the device to be cooled, and the sealed enclosure for the cold finger and device to be cooled as discussed in connection with FIGS. 1–3. A suitable cryogen 146 is contained within the inner vessel to provide the desired low temperature environment.

In accordance with the teachings of the present invention, a second port to accommodate a device chamber is provided in the cryostat at any desired location in order the provide the desired alternative locations of the device chamber including a radiation detector or other use device. In the illustrated embodiment, port 150 is provided near the bottom of cryostat 140 and spaced above the bottom wall of the inner vessel 143, the location of port 150 being selected to best provide the multiple uses intended for the cryostat 140 and the device chamber; it is also clear that a plurality of such ports can be provided in the appropriate cryostat, and that the angular orientation of such ports may be determined as desired.

In order to provide the access opening for port 150, a suitable aperture is provided in wall 142 and a flange 152 is welded and sealed to the sidewalls of the opening in wall 142. Additionally, a coaxially alligned aperture 158 is provided in inner wall 143 and stainless steel tube 160 is suitably joined and sealed to the sidewalls of aperture 158 as by welding or an epoxy joint as may be desired. Affixed and sealed to the end of tube 160 is heat sink 162 typically formed of aluminum, copper, or other good heat conducting material, which heat sink is generally cup-shaped. If desired, some support can be provided for heat sink 162 within inner vessel 143 thereby to relieve the stresses which might be imparted to the joint 158 by the illustrated cantilever-type support, but such support features are not deemed to be part of the present invention.

In order to ensure that the tubular passageway created by tube 160 and heat sink 162 does not affect the ability to establish a vacuum between walls 143 and 142 of cryostat 140, a stainless steel bellows 165 is provided and suitably affixed and sealed to the sidewalls of aperture 158, end of tube 160 and to the inner diameter of flange 152. By utilizing such a stainless steel bellows, wall thicknesses are thin and of extended length thereby to reduce heat transfer while at the same time providing stress relief between the inner and outer walls of cryostat 140. With such a construction properly placed, the desired vacuum between the inner and outer walls of cryostat 140 can be suitably provided as through evacuation port 167 in outer wall 142. For completeness, it is noted that a molecular sieve or getter 168, similar to that used in prior art constructions is provided in an amount and location desired to assist in preserving the internal vacuum.

To complete the construction of port 150 as a further location for a suitable device chamber, there is provided a second flange 170 which is bolted and sealed to flange 152, flange 170 having a tubular end or sleeve 172 which is provided with suitable threads 173.

Turning next to device chamber 180 which is shown for illustration purposes as having an offset or L-shaped arm configuration, it is seen that device 182, which may typically be a semi-conductor radiation detector, is suitably supported on end 183 of cold finger 184 and in good heat conducting relationship therewith. Cold finger 184 is formed of copper or other good heat conducting material and extends from object 182 in its operative position into cup-shaped heat sink 162. The end configuration of copper cold finger 184 has an external configuration which closely mates with the internal configuration of the opening in cup 162 so as to be in good heat conducting contact with heat sink 162 but removable therefrom. If desired to enhance the heat conducting effect while assisting the removability of finger 184, the end of cold finger 184 can be coated with a heat conducting grease.

A sealed housing or enclosure for cold finger 184 is shown as including stainless steel tube 186, which tube is brazed or otherwise sealed to cold finger 184 at 187. The diameter of tube 186 is maintained as small as convenient, to substantially occupy the internal volume of tube 160 and, at the same time, to be in close proximity to sleeve 172. Tube 186 is provided with an enlarged outer end portion 188 which is affixed and sealed to flange 189; flange 189, in turn, is bolted and sealed to flange 190 which, in turn, is affixed and sealed to housing 192 thereby to provide an air-tight enclosure for the cold finger and the device to be cooled. A vacuum is established through aperture 193 to improve resistance of the composite device chamber to heat loss while enhancing the heat conducting characteristic of cold finger 184. As with the cryostat itself, a suitable getter material may be placed within the closed volume of the tube 186.

To effect sealing of device chamber 180 and particularly tube 186 relative to wall 142 of cryostat 140, there is provided an O-ring seal 195 and a threaded collar 196 such that, after insertion of cold finger 184 into good heat conducting relationship with heat sink 162, the remaining air space or volume between O-ring 195 and heat sink 162 as defined by tube 160 and bellows 165 is sealed.

If the entrapped gas volume is small and of low thermal conductivity (such as Nitrogen), and if the heat transfer path is restricted, evacuation may not be necessary. Nonetheless getter material 200 may be used to evacuate that closed volume to reduce heat transfer.

For completeness, it is noted that the necessary electrical connections to a semi-conductor radiation detector 182 can be provided through the appropriate housing member in accordance with prior art techniques.

If it is desired to withdraw device chamber 180 from port 150, it is merely necessary to loosen the threaded collar 196 to relieve compression of O-ring 195 and withdraw the entire device chamber including the cold finger from that port. Removal of the cryogen is generally advisable before removing the device chamber if in fact that port is not going to be used for a particular application, it is advisable to evacuate the port (with a suitable getter) and insert a plug through the open end of collar 172 to minimize the formation of ice and frost, minimize the ingress of contamination and to further reduce heat loss.

In operation it is seen that the copper cold finger 184 is in intimate heat conducting relationship with the cup-shaped heat sink 162 which is effectively immersed in cryogen 146. The desired temperature is thereby provided at detector 182 with heat loss through the device chamber housing 186 being minimized by the use of low-heat conducting enclosure members and by establishing the desired heat transfer inhibiting vacuum within the housing. Because of the unique mounting configuration, device chamber 180 can be rotated about the axis of the cold finger (without requiring removal of the cryogen) thereby permitting a wide variety of locations to be established for detector 182.

Additionally, this same cryostat 140 can accommodate, simultaneously if desired, a second device chamber inserted through neck 144. Moreover, it is clearly possible to provide plural additional ports for device chambers of the same general type as described in a variety of bottom, side and/or angular positions thereby to establish a multiple-port, convertible cryostat which will permit selection of a variety of detector locations and orientations without necessitating replacement of the entire cryostat assembly with one which has the desired detector location and without requiring special tools or structural modification of the cryostat.

As will be apparent to persons skilled in the art, various modifications, adaptations and variations of the foregoing specific disclosure can be made without departing from the teachings of this invention.

I claim:

1. An improved cryostat having a plurality of ports for accepting devices to be maintained at low temperature comprising a Dewar container having an inner vessel for containing a cryogen in a liquid state and an outer vessel joined to said inner vessel to define a volume therebetween for evacuation, said Dewar having a top opening through which the cryogen may evaporate and into which a device chamber may be inserted to become at least partially immersed in the cryogen and at least one additional port for accepting a device chamber which port extends through said inner and outer vessels, said second port including a tube structure closed at its inner end, sealed to the inner wall so as to be isolated from the interior of said inner vessel and terminating at its inner end in a heat sink, said port including a tubular member affixed and sealed to said tube and to the other vessel wall of said cryostat thereby maintaining the intergrity of the vacuum between the inner and outer vessel walls, said tube extending into the inner container to be at least partially immersed in the cryogen.

2. The improved cryostat of claim 1 wherein a device chamber comprising a cold finger and object to be cooled is enclosed in a sealed container with the cold finger extending outwardly of the container is inserted into said second port with the outwardly extending portion of the cold finger in good heating conducting contact with said heat sink.

3. The improved cryostat of claim 2 wherein said heat sink and cold finger have complementary configurations to enhance conducting contact.

4. The improved cryostat of either claim 2 or claim 3 wherein said device chamber is evacuated to reduce unwanted heat transfer and removeable sealing means are provided between said device chamber and the outer vessel wall when said device chamber extends into said second port with the cold finger in juxtaposition with said heat sink.

5. The improved cryostat of claim 1 including removeable closure means for said second port.

* * * * *

UNITED STATES PATENT AND TRADEMARK OFFICE

CERTIFICATE OF CORRECTION

PATENT NO. : 4,510,758

DATED : April 16, 1985

INVENTOR(S) : Orren K. Tench, Jr.

It is certified that error appears in the above—identified patent and that said Letters Patent is hereby corrected as shown below:

Column 2, line 40, delete the word "number" and substitute therefor--numeral--

Signed and Sealed this

*Twenty-ninth* Day of *October 1985*

[SEAL]

*Attest:*

DONALD J. QUIGG

*Attesting Officer*

*Commissioner of Patents and Trademarks—Designate*